United States Patent [19]

Smart et al.

[11] Patent Number: 4,903,875

[45] Date of Patent: Feb. 27, 1990

[54] SKI-CARRYING DEVICE

[76] Inventors: Peter E. Smart; Patricia G. Smart, both of "Romany", 100 Oakhill Road, Sevenoaks, Kent, United Kingdom, TN13 1NU

[21] Appl. No.: 153,822

[22] PCT Filed: May 20, 1987

[86] PCT No.: PCT/GB87/00343

§ 371 Date: Feb. 11, 1988

§ 102(e) Date: Feb. 11, 1988

[87] PCT Pub. No.: WO87/07170

PCT Pub. Date: Dec. 3, 1987

[30] Foreign Application Priority Data

May 20, 1986 [GB] United Kingdom ..... 8612188
Aug. 1, 1986 [GB] United Kingdom ..... 8618795

[51] Int. Cl.[4] ..... A45F 3/14

[52] U.S. Cl. ..... 224/258; 224/257; 224/149; 224/917; 224/205; 224/255; 224/268

[58] Field of Search ..... 224/257, 258, 917, 268, 224/149, 203, 205, 242, 255, 250

[56] References Cited

U.S. PATENT DOCUMENTS

| | | | |
|---|---|---|---|
| 2,884,172 | 4/1959 | Kubo | 224/149 |
| 3,182,871 | 5/1965 | Gossler | 224/149 |
| 3,278,097 | 10/1966 | Duckworth | 294/149 |
| 3,905,610 | 9/1975 | Dini | 294/148 |
| 4,456,284 | 6/1984 | Saka | 224/917 |
| 4,463,885 | 8/1984 | Ball et al. | 224/257 |

FOREIGN PATENT DOCUMENTS

| | | | |
|---|---|---|---|
| 2916392 | 11/1980 | Fed. Rep. of Germany . | |
| 3344611 | 6/1985 | Fed. Rep. of Germany | 224/917 |
| 3526278 | 2/1986 | Fed. Rep. of Germany . | |
| 2305210 | 3/1974 | France . | |
| 2508808 | 1/1983 | France . | |
| 405132 | 7/1966 | Switzerland . | |

*Primary Examiner*—Stephen Marcus
*Assistant Examiner*—Christine A. Peterson
*Attorney, Agent, or Firm*—Browdy and Neimark

[57] ABSTRACT

A device for carrying skis comprises a flexible strap (12) formed at one end with a pocket (22) to receive the ski ends and having at the other end of the strap (12), fastening means (28, 30) adapted to grip the skis. The device allows the skis to be carried substantially vetically with the strap (12) over the user's shoulder and is formed of plastics webbing material to be foldable, when not in use, to approximately pocket size. The pocket (22) mouth is unrestricted and can be arranged for simple insertion of the skis without the need to guide the pocket (22) by hand.

10 Claims, 2 Drawing Sheets

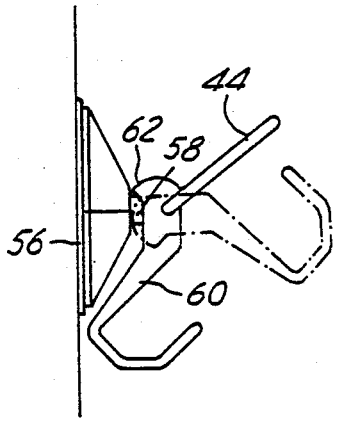
FIG. 4
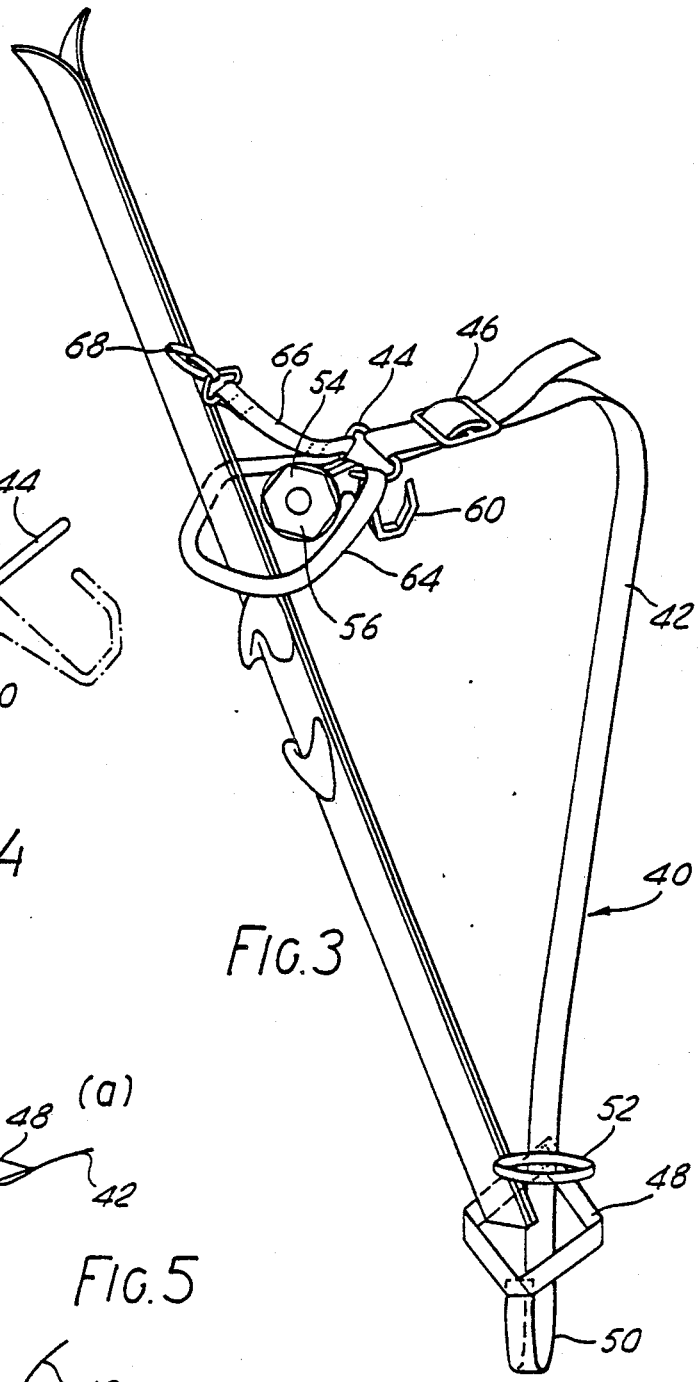
FIG. 3
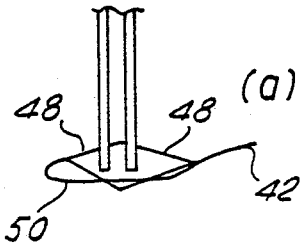
FIG. 5
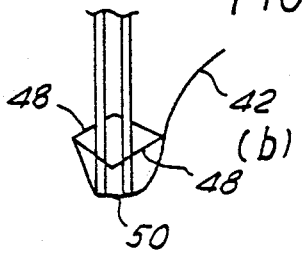

SKI-CARRYING DEVICE

This invention relates to the sport of skiing and more particularly to a device for carrying skis and—optionally—certain other items of ski equipment.

There are numerous instances in which it is necessary to transport skis on the person; examples are between cars and piste, on cable cars or during shopping. Flexible bands are available to fasten two skis back-to-back and the customary practice is then to transport the skis horizontally over the shoulder. As will be evident, this can cause difficulties in confined spaces and there are also problems in carrying ski sticks and other ancillary items such as gloves. Devices are also available which incorporate a strap extending between two loops. These loops are adapted to grip the skis and the strap is held either in the hand or over the shoulder. Various forms of loop fasteners have been proposed including toggles and burr-type fasteners. Bearing in mind that the skier will often be wearing gloves when using the device, known loop fasteners can cause difficulties. Even in the case where a non-tightening loop is employed, there is the difficulty of threading the ski ends through the loop, this involving either lifting the skis or bending.

Rigid containers and bags are available for storage of skis and these are suitable for transporting skis to and from a ski resort or for any other occasion where there are facilities at the destination for storing the container, once the skis have been unloaded. These containers are not suitable for the instances of temporary transit mentioned above, since the container itself presents a transport problem when the skis are in use.

Certain ski-carrying devices have been proposed which deal, to a limited extent, with the difficulties outlined above. Reference is directed to CH-A-405 132 and FR-A-2 305 210. The ski-carrying device disclosed in CH-A-405 132 is made of a number of separate component parts and is likely to be expensive to manufacture. Moreover, the fastener provided for engagement with the skis intermediate their length is felt likely to be awkward in use and not easily adaptable to skis of varying size. The ski-carrying device disclosed in FR-A-2 305 210 is of a simple construction in that a pocket for receiving the ski ends is formed from a bight in the flexible strap itself. This is believed to be an advantage. However, the bight formed in the flexible strap is closed with the end of the strap passing over the mouth of the pocket. It is believed that this will obstruct the entry of the skis into the pocket so complicating the procedure of applying the device to the skis. It is a further difficulty with the ski-carrying devices of both citations that the pocket which is adapted to receive the ski ends, requires to be guided by hand when the skis are inserted. This will normally require the operator to either lift the skis or bend to the floor.

It is an object of this invention to provide an improved ski-carrying device which can be simply and quickly applied to the skis, even where finger dexterity is limited by cold or by the wearing of gloves.

Accordingly, the present invention consists in a ski-carrying device comprising a flexible strap of adjustable length which is folded at one end to form a bight; a band secured to said one end of the strap and to a portion of the strap adjacent said end thereby forming with said bight a pocket having an unrestricted pocket mouth and being adapted to receive the ends of two skis; and fastening means formed at the opposite end of said strap and being adapted to grip the skis at a point intermediate their length, the strap being of a sufficient length to enable the skis to be carried substantially vertically with the strap over the user's shoulder and the device being foldable, when not in use, to approximately pocket size.

In a preferred example, said band is arranged normally to adopt an open, flattened position in which said one end of the strap and said strap portion are spaced longitudinally thereby exposing a region of said bight within the band opening, such that the pocket may be laid on the ground to receive the ski ends, subsequent tension in the flexible strap with the ski ends engaging the bight through the band opening then serving to lift the band relatively to the skis to a position in which it encircles and holds the ski ends.

The ability of the device according to this form of the invention to receive the ski ends with the pocket lying on the floor, offers a considerable simplification. The user need not lift the ski ends to hand height nor bend to ground level. The pocket of the device is simply thrown to the ground and the vertically held skis displaced sideways until the ends lie within the band opening. Pulling on the opposite end of the flexible strap will then complete the engagement.

The invention will now be described by way of examples with reference to the accompanying drawings in which:

FIG. 3 is a perspective view of a ski-carrying device according to a further form of this invention, in association with a pair of skis;

FIG. 4 is a detailed view of the fastening element shown in FIG. 3; and

Figures 1, 2:
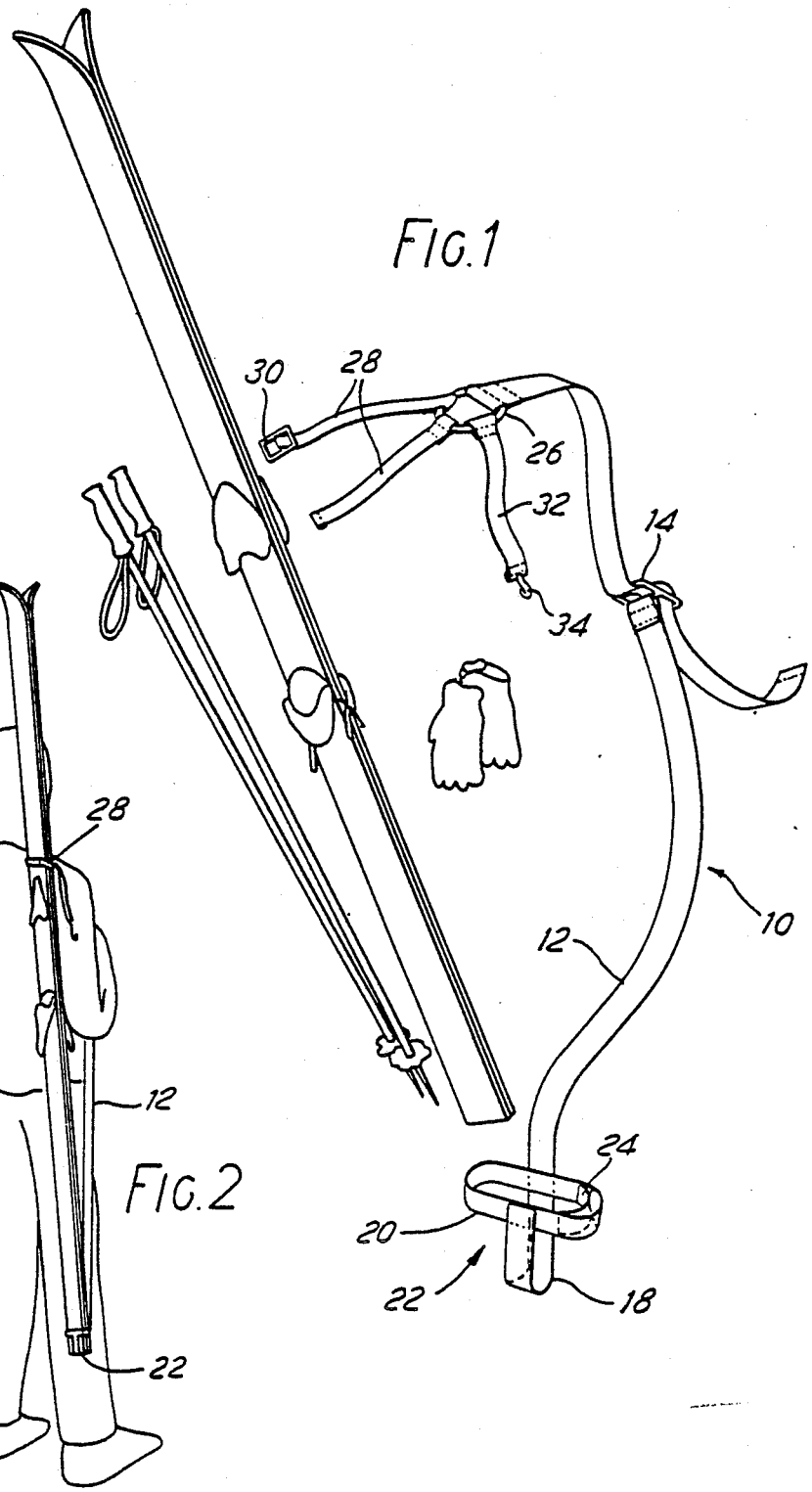
FIG. 1 is a perspective view of a ski-carrying device according to one form of this invention, in association with pairs of skis, sticks and gloves.
FIG. 2 is a sketch illustrating use of the ski-carrying device shown in FIG. 1.

FIGS. 5*a* and 5*b* are line diagrams illustrating the principle of operation of the device shown in FIG. 3.

The device shown generally at 10 in FIG. 1 comprises a main strap 12 formed with a buckle arrangement 14 enabling the length of the strap to be adjusted. The strap is preferably formed of nylon, polyester or other suitable plastics webbing material. One end of the strap is upturned to form a U-shaped bight portion 18 and a band 20 is received in the bight portion and bonded by welding, stitching or any other suitable technique. The band and the bight portion form in combination a pocket 22 which is adapted to receive the ends of two skis. In order to ensure that the skis are gripped firmly in the pocket, the band 20 is preferably formed with an elasticated insert 24.

The opposite end of the main strap 12 carries a ring 26 on which are secured two fastening straps 28 having at their respective free ends the inter-engaging elements of a buckle 30 or other suitable fastener. These fastening straps are arranged to encircle and grip the skis at a point intermediate the ski length and, suitably, immediately above the toe-receiving elements on the skis. The fastening straps 28 also encircle and grip the ends of the ski sticks if these are also carried. The ski sticks may if desired be further held in place by looping or otherwise securing the stick wrist bands around the skis. The ring 26 also carries a glove strap 32 having a clip 34 at its free end for engagement with the fastening devices provided on ski gloves and normally intended for engagement with ski sticks. This same clip 34 may usefully also carry an anorak.

Once the skis, and any other ancillary equipment, have been secured in the device, the main strap 12 is passed over the shoulder and the skis transported in a substantially vertical orientation as illustrated in FIG. 2. Not only is this method of carrying skis safer and capable of greater manoeuvreability in confined spaces, it is also helpful in freeing both hands for other purposes. In this latter regard, the importance will be seen of carrying on the device such ancillary equipment as sticks and gloves.

When the skis are to be used, it is a simple matter to remove the skis and other items. The device can then be folded and carried, for example, in an anorak pocket.

Since the pocket 22 has an unrestricted pocket mouth, it is a relatively straightforward operation to insert the ski ends. An alternative embodiment of this invention in which the operation of inserting the ski ends is further simplified will now be described with reference to FIGS. 3, 4 and 5.

The device shown generally at 40 comprises a main strap 42 looped at one end through a D-ring 44 and fastened with a buckle 46. This buckle enables the length of the strap to be adjusted. Near the opposite end of the main strap 42 there are stitched or otherwise suitably bonded two band portions 48. These are preferably formed of the same webbing material as the strap. As seen in FIG. 3, the band portions 48 are inclined at an angle of approximately 45 degrees to the downwardly continuing main strap. The two band portions are folded at their mid-points and rejoined to form a diamond shape. The free ends of the band portions are stitched to the free end of the main strap, that portion of the strap between the interconnections with the band portions forming a bight 50 which serves as the base of the pocket. The pocket assembly is completed by an elasticated cuff 52 which is stitched to the main strap near the inward connection thereto of the band portions.

At the opposite end of the strap 42, the D-ring 44 carries a suction element 54. This is a commercially available element and comprises a suction pad 56, a stem 58 and an operating lever 60 which is pivotally connected to the stem and incorporates a nose 62. It will be understood that as the lever 60 is moved from the position shown in full lines in FIG. 4 towards the position shown in dotted lines, the nose 62 engages the suction pad 56 to draw the stem 58 outwardly and create a partial vacuum within the pad.

The D-ring 44 additionally carries a non-tightening safety loop 64 and a glove strap 66 having at its free end a clip 68 for engagement with ski gloves or other accessories.

The manner of operation of the described device can now be understood. When not in use, the device can be rolled or folded to occupy a relatively small volume and can be easily carried, for example, in a pocket. When the skis are taken off, they are fastened together using the inter-engaging ski bindings (if this feature is provided on the skis) or with flexible bands. The device according to this invention is unwound and the pocket end laid on the floor. As a result of the described construction of the pocket, this will adopt the position shown schematically in FIG. 5*a*. The band portions 48 define a band opening which lies in the same plane as the band portions themselves and the band opening exposes part of the bight 50. The ski ends are placed on this part of the bight and thus within the extremeties of the pocket mouth. Pulling on the main strap 42 will then cause the band portions to move a short distance up the skis to the position shown in FIG. 5*b*. It will be understood that in both the flattened and working positions, the band portions define an open pocket mouth. In the flattened position shown in FIG. 5*a*, the plane of the opening is parallel to the plane of the main strap. The flattened band portions occupy substantially the same plane. In the working position shown in FIG. 5*b*, the plane of the pocket mouth is orthogonal to the plane of the vertical strap; the band portions are similarly arranged normally to the plane of the mouth opening.

At the opposite end of the main strap, the safety loop is, if required, passed over the ends of the skis and the suction element 54 is offered up to a smooth surface of one ski such that the suction pad is in contact at all points around its periphery. The lever 60 is then actuated to create a suction effect which is of sufficient strength to support the necessary fraction of the weight of the skis with the main strap 42 looped over the user's shoulder. The safety strap plays no direct part in the mounting of the skis in the device but prevents the skis falling to the ground in the event of failure, or accidental dislodgement of the suction element.

If desired, ski gloves or other accessories such as an anorak can be fastened to clip 68. Ski sticks can also be carried by passing the skis through the stick wrist loops before the ski ends are inserted in the device pocket. The tips of the sticks are then held in the safety loop 64. Boots can be carried simply by leaving them clamped in the ski bindings.

If it is desired to use the described device to carry skis for a longer period or in circumstances in which they are likely to be placed on the ground and relifted, the bottom-most ski ends can additionally be passed through the elasticated cuff 52. This lessens the chances of the pocket falling away from the skis when these are placed on the ground and relifted. In situations where the skis are to be transported from one location to another without such an interval, the additional complication of passing the ski ends through the cuffs can be dispensed with.

It should be understood that this invention has been described by way of examples only and a variety of modifications are possible without departing from the scope of the invention. Thus, for example, the pocket which is described with reference to FIGS. 3, 4 and 5 could be employed with the fastening means illustrated in FIG. 1 or indeed with other fastening means which are adapted to grip the skis at a point intermediate their length. It will be possible, for example, to use a single strap which fastens back on itself or an elasticated cuff which was secured in a suitable manner to the end of the flexible strap.

We claim:

1. A ski-carrying device comprising a flexible strap of adjustable length which is folded at one end to form a bight; a band secured to said one end of the strap and to a portion of the strap adjacent said end thereby forming with said bight a pocket having an unrestricted pocket mouth and being adapted to receive the ends of two skis; and fastening means formed at the opposite end of said strap and being adapted to grip the skis at a point intermediate their length, the strap being of a sufficient length to enable the skis to be carried substantially vertically with the strap over the user's shoulder and the device being foldable, when not in use, to approximately pocket size, wherein said fastening means comprises a suction element adapted to grip one of the skis through a suction effect.

2. A ski-carrying device according to claim 1, wherein said band is arranged normally to adopt an open, flattened position in which said one end of the strap and said strap portion are spaced longitudinally thereby exposing a region of said bight within the band opening, such that the pocket may be laid on the ground to receive the ski ends, subsequent tension in the flexible strap with the ski ends engaging the bight through the band opening then serving to lift the band relatively to the skis to a position in which it encircles and holds the ski ends 3. A ski-carrying device according to claim 2, wherein the band and the band opening are adapted normally to lie in the same plane.

4. A ski-carrying device according to claim 3, wherein said band is formed by two band portions, each band portion being secured at an angle to said strap end and to said strap portion, each band portion being folded between its ends.

5. A ski-carrying device according to claim 1, wherein an elasticated cuff is provided within said band to engage the ski ends more firmly.

6. A ski-carrying device according to claim 1, wherein hook means are provided at said opposite end of the flexible strap for engagement with ski gloves or other item of ski equipment.

7. A ski-carrying device according to claim 1, wherein said fastening means comprises a pair of fastening straps adapted to be fastened around said skis.

8. A ski-carrying device according to claim 1, wherein the fastening means further comprises a non-tightening safety loop which may be passed over the ski ends prior to engagement of the suction element.

9. A ski-carrying device according to claim 2, wherein said flexible strap is formed of plastics webbing.

10. A ski-carrying device comprising a flexible strap of adjustable length which is folded at one end to form a bight; a band secured to said one end of the strap and to a location in the strap adjacent said end thereby forming with said bight a pocket adapted to receive the ends of two skis; and fastening means formed at the opposite end of said strap and being adapted to grip the skis at a point intermediate their length, the strap being of a sufficient length to enable the skis to be carried substantially vertically with the strap over the user's shoulder, wherein said band is formed of two flat strip portions, each strip portion being secured at an inclined angle to said location in the strap end and being folded flat between its ends, the band being thereby arranged normally to adopt an open, flattened position in which said folded strip portions and the band opening lie in the same plane and said one end of the strap and said location in the strap are spaced longitudinally of the strap to expose a region of said bight within the band opening, such that the pocket may be laid flat on the ground to receive the skis with the ski ends resting on said region, subsequent tension in the flexible strap with the ski ends engaging the bight through the band opening then serving to lift the band relatively to the skis to a position in which it encircles and holds the ski ends.

* * * * *